US005086607A

United States Patent [19]

Ozeki

[11] Patent Number: 5,086,607

[45] Date of Patent: Feb. 11, 1992

[54] WRAPPING PAPER FEEDING APPARATUS FOR COIN WRAPPING MACHINE

[75] Inventor: Masamichi Ozeki, Ashikaga, Japan

[73] Assignee: Laurel Bank Machines Co., Ltd., Tokyo, Japan

[21] Appl. No.: 664,844

[22] Filed: Mar. 5, 1991

[30] Foreign Application Priority Data

Mar. 14, 1990 [JP] Japan ..... 2-25660
Feb. 27, 1991 [JP] Japan ..... 3-31233

[51] Int. Cl.[5] ..... B65B 11/04

[52] U.S. Cl. ..... 53/64; 53/212; 53/389.3; 53/389.4; 83/65

[58] Field of Search ..... 53/64, 66, 212, 211, 53/532, 389.4, 389.3, 587; 83/65, 336, 365

[56] References Cited

U.S. PATENT DOCUMENTS 3,757,619 9/1973 Gianese ..... 53/64 X
4,047,361 9/1977 Ono et al. ..... 53/212
4,554,775 11/1985 Asami et al. ..... 53/389.3 X
4,781,010 11/1988 Furuya et al. ..... 53/64
4,835,938 6/1989 Sakurai ..... 53/389.4 X

*Primary Examiner*—James F. Coan

*Attorney, Agent, or Firm*—Fleit, Jacobson, Cohn, Price, Holman & Stern

[57] ABSTRACT

A wrapping paper feeding apparatus for a coin wrapping machine in which a wrapping paper is withdrawn and fed to wrapping rollers by feed roller and stacked coins are wrapped by winding the wrapping paper therearound by use of wrapping rollers, the wrapping paper feeding apparatus including a turntable for holding a wrapping paper roll thereon, a motor for rotating the turntable, a blower disposed between the turntable and the feed roller for blowing air toward the wrapping paper fed out from the wrapping paper roll so as to form the wrapping paper with a loop, a sensor for detecting the loop of the wrapping paper, and a controller for causing the motor to stop rotation of the turntable when the sensor detects the loop of the wrapping paper and causing the motor to rotate the turntable when the sensor does not detect the loop of the wrapping paper. In this wrapping paper feeding apparatus, since the loop is formed by air blown from the blower in a desired manner and the wrapping paper can be fed out from the wrapping paper roll so that the tensile force produced in the wrapping paper between the wrapping paper roll and the feed roller becomes substantially zero, slippage between the wrapping paper roll and the feed roller can be prevented.

16 Claims, 4 Drawing Sheets

WRAPPING PAPER FEEDING APPARATUS FOR COIN WRAPPING MACHINE

CROSS REFERENCE TO RELATED APPLICATION

The present invention relates generally to the subject matter of the following prior U.S. patent application Ser. No. 07/534,655, filed on June 7, 1990, entitled "Feeder of Wrapping Paper for Coin Wrapping Machine".

BACKGROUND OF THE INVENTION

The present invention relates to a wrapping paper feeding apparatus for a coin wrapping machine, and, more particularly, to such an apparatus capable of successively wrapping a large number of coins.

DESCRIPTION OF THE PRIOR ART

As shown in U.S. Pat. No. 4,835,938, in the prior art coin wrapping machine, coins deposited into the coin wrapping machine are fed one by one from a rotatable disk to a coin passage, counted and fed to a portion between a pair of stacking drums where they are stacked. Then, the thus stacked coins are fed between three wrapping rollers and a wrapping paper drawn out from a wrapping paper roll by a feed roller is wound around the stacked coins by the wrapping rollers, thereby to obtain roll-like wrapped coins.

In this coin wrapping machine, since the wrapping paper is withdrawn from the wrapping paper roll by the feed roller, in the case where a wrapping paper roll of a larger diameter is used for successively wrapping a large number of coins, slippage occurs between the feed roller and the wrapping paper due to the heavy weight of the wrapping paper roll, whereby the wrapping paper cannot be fed to the circumference of the stacked coins in a desired manner.

SUMMARY OF THE INVENTION

The object of the present invention is, therefore, to provide a wrapping paper feeding apparatus for a coin wrapping machine in which a wrapping paper is withdrawn by feed roller means and stacked coins are wrapped by winding the wrapping paper therearound by use of wrapping roller means, the wrapping paper feeding apparatus being capable of preventing slippage between the feed roller means and the wrapping paper and feeding the wrapping paper to wrapping roller means in a desired manner.

According to the present invention, the above and other objects can be accomplished by a wrapping paper feeding apparatus for a coin wrapping machine in which a wrapping paper is withdrawn by feed roller means and stacked coins are wrapped by winding the wrapping paper therearound by use of wrapping roller means, said wrapping paper feeding apparatus comprising said feed roller means for withdrawing the wrapping paper from a wrapping paper roll and feeding the same to the wrapping roller means, supporting means for holding said wrapping paper roll thereon, said supporting means being rotatable in substantially the horizontal plane, drive means for rotating said supporting means, blower means disposed between said supporting means and said feed roller means for blowing gas toward the wrapping paper fed out from said wrapping paper roll so as to form the wrapping paper with a loop, sensor means for detecting said loop of the wrapping paper, and control means for causing said drive means to stop rotation of said supporting means when said sensor means detects said loop of the wrapping paper and causing said drive means to rotate said supporting means when said sensor means does not detect said loop of the wrapping paper.

In a preferred aspect of the present invention, there is further provided guide means for guiding the wrapping paper between said supporting means and said feed roller means on the opposite side to said blower means with respect to the wrapping paper.

The above and other objects and features of the present invention will become apparent from the following description made with reference to the accompanying drawings.

PREFERRED EMBODIMENTS OF THE PRESENT INVENTION

Figure 1:
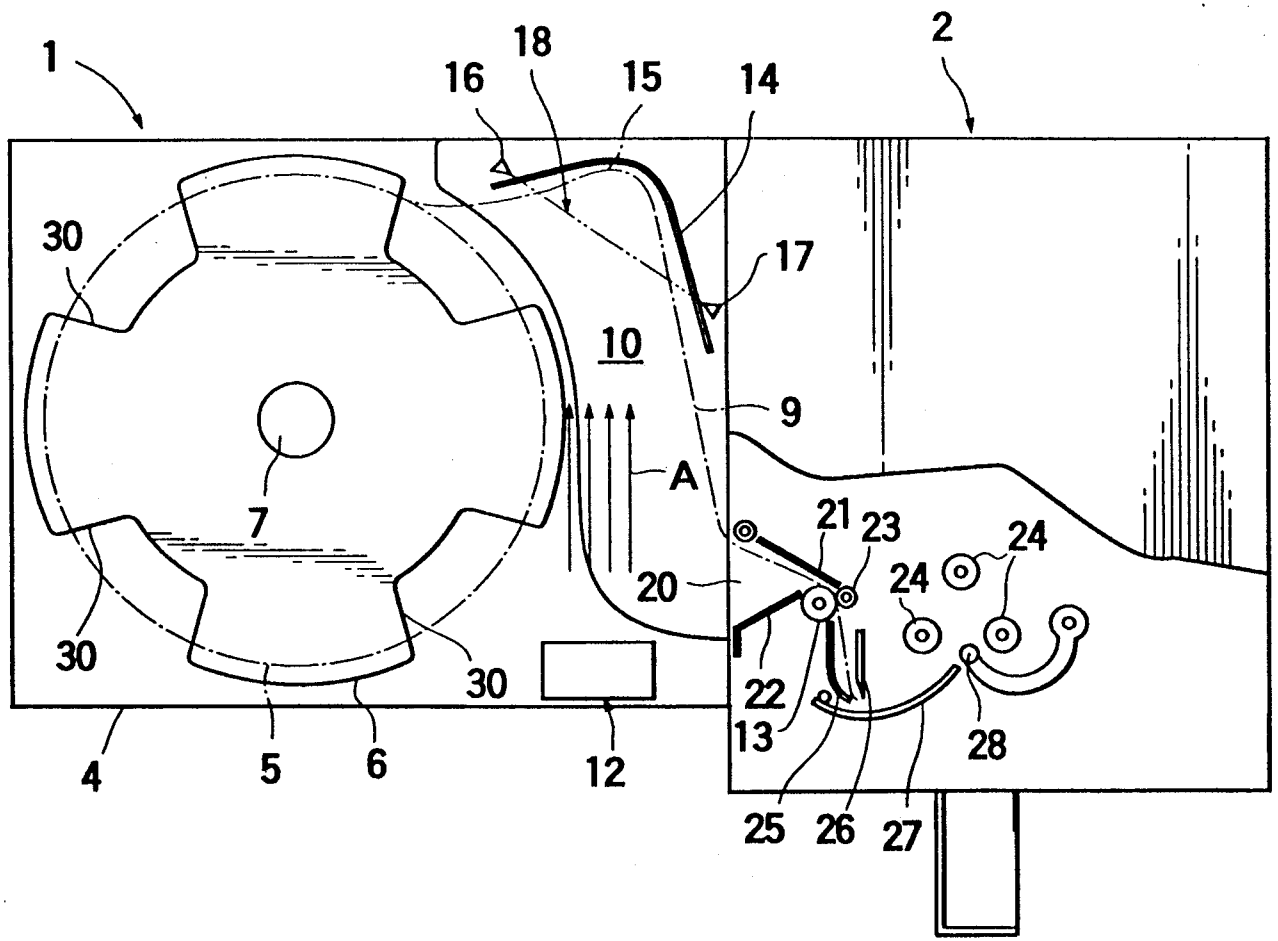
FIG. 1 is a schematic drawing showing a plan view of a wrapping paper feeding apparatus for a coin wrapping machine which is an embodiment of the present invention, together with the coin wrapping machine.
Figure 2:
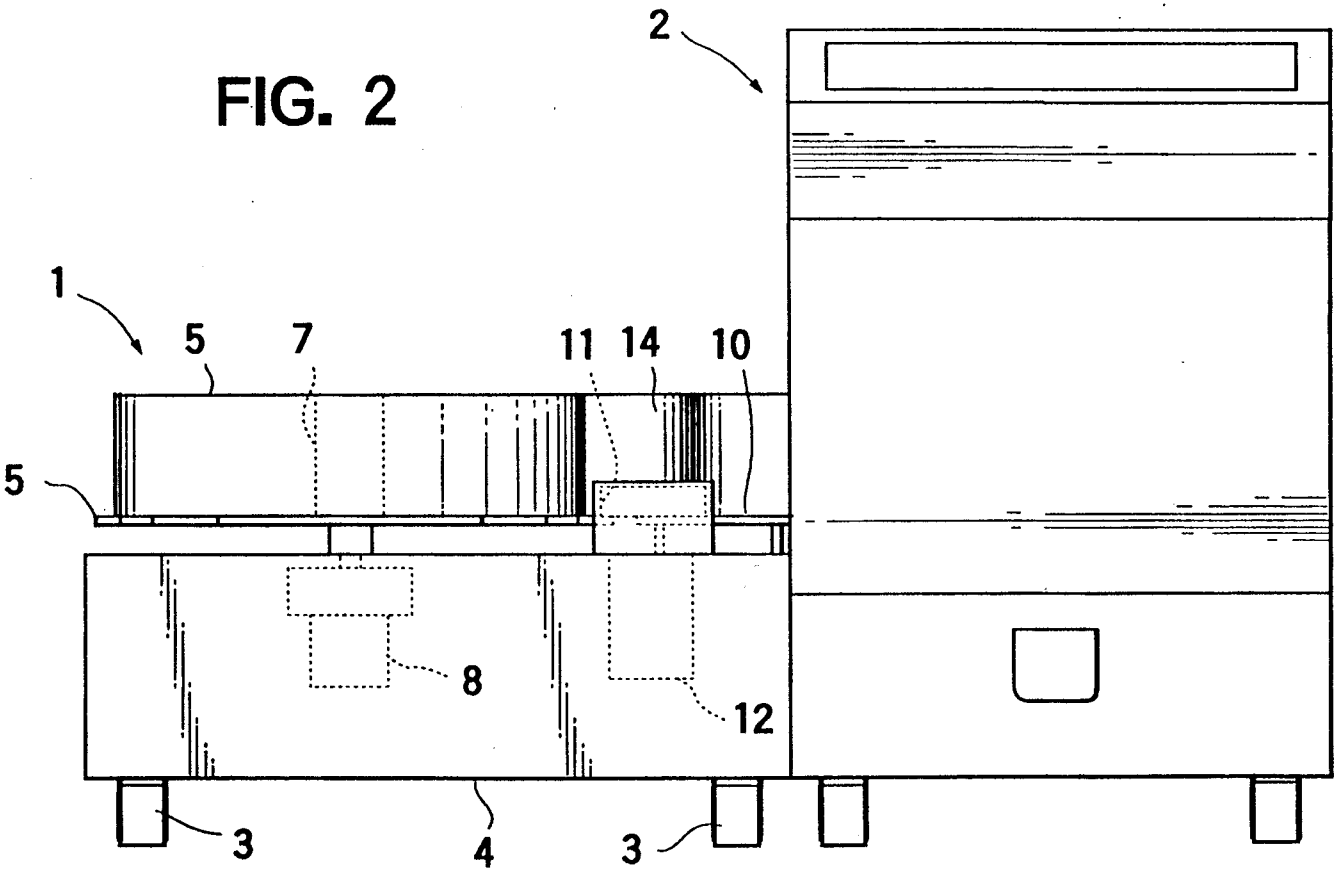
FIG. 2 is a schematic drawing showing a side view of a wrapping paper feeding apparatus for a coin wrapping machine which is an embodiment of the present invention, together with the coin wrapping machine.
Figure 3:
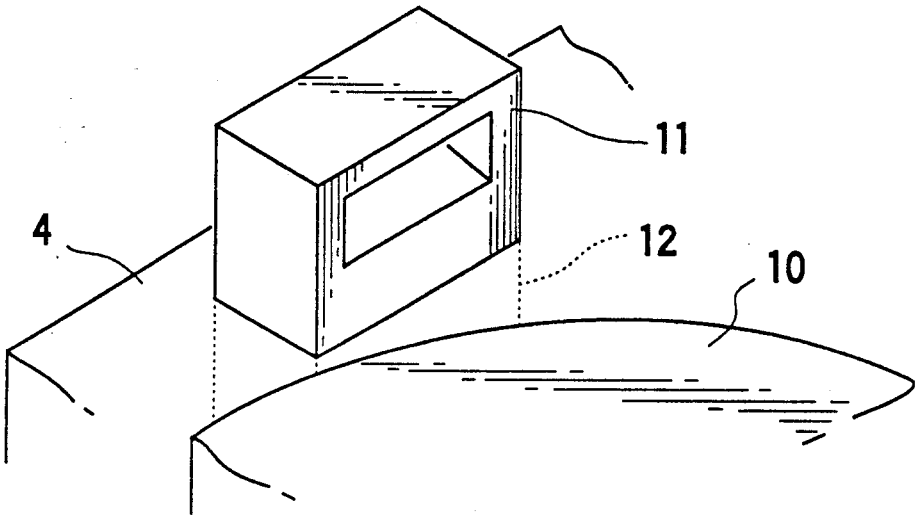
FIG. 3 is a schematic drawing showing a perspective view of a blower.
Figure 5:
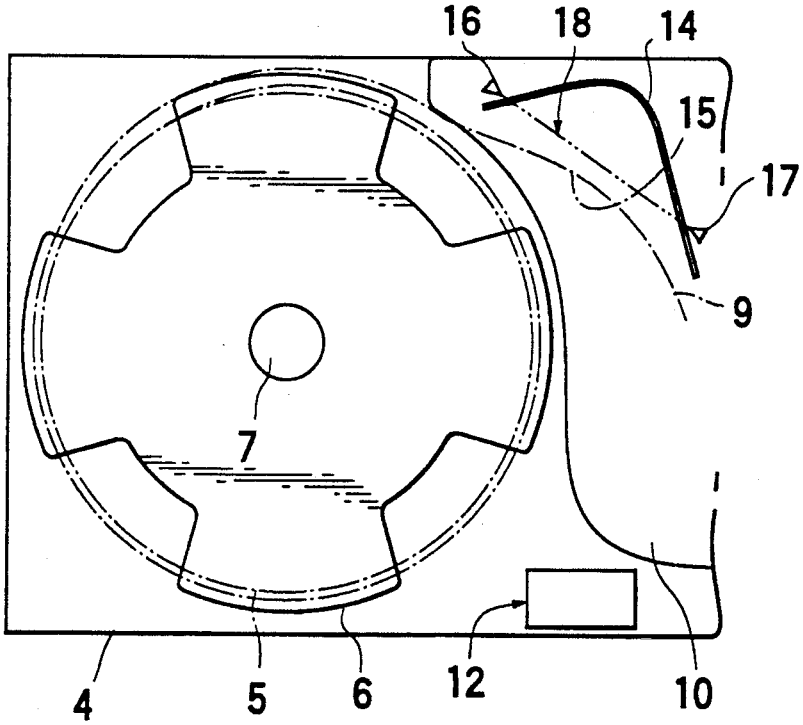
FIG. 5 is a schematic drawing showing a plan view of a wrapping paper feeding apparatus for a coin wrapping machine which is an embodiment of the present invention in the state where a photosensor does not detect a loop of the wrapping paper.

FIG. 1 is a schematic drawing showing a plan view of a wrapping paper feeding apparatus 1 for a coin wrapping machine 2 which is an embodiment of the present invention, together with the coin wrapping machine 2 itself and FIG. 2 is a schematic drawing showing a side view thereof. In FIG. 1, only a wrapping portion of the coin wrapping machine 2 is shown and the remaining portions are omitted.

Referring to FIGS. 1 and 2, a wrapping paper feeding apparatus 1 for a coin wrapping machine .which is an embodiment of the present invention is secured to the side of the coin wrapping machine 2 and comprises a frame 4 supported by a plurality of castors 3 secured to the bottom portion thereof, a turntable 6 which is rotatably supported on the frame 4 and on which a wrapping paper roll 5 is placed, a motor 8 which is disposed in the frame 4 and connected to the shaft 7 of the turntable 6, a support plate 10 provided so that the upper face thereof is in the same plane as that of the turntable 6 and adapted for supporting the lower edge of the wrapping paper 9 fed out from the wrapping paper roll 5, a blower 12 disposed in the frame 4 and adapted for blowing air toward the wrapping paper 9 as indicated by an arrow A from a blowing opening 11 formed so as to project above the upper face of the turntable 6, a guide plate 14 disposed on the support plate 10 and adapted for guiding the wrapping paper 9 fed out from the wrapping paper roll 5 so as to be fed to a feed roller 13, and a photosensor 18 consisting of a light emitter 16 and a light receiver 17 and detecting a loop 15 of the wrapping paper 9.

The height of the frame 4 is adjustable and the frame 4 can be connected to the coin wrapping machine.

As shown in FIG. 1, the guide plate 14 is formed in such a manner that the inner face thereof facing the blower 12 is concave so as to ensure that the wrapping paper 9 will be formed with a loop 15 without fail even if the wrapping paper 9 is being fed along the inner face of the guide plate 14.

One side of the coin wrapping machine 2 is formed with an opening 20 adapted for communicating with the wrapping paper feeding apparatus 1 and a pair of guide plates 21, 22 are provided inside of the opening 20 for guiding the wrapping paper 9 to a feed roller 13. Further, a press roller 23 is provided adjacent to the feed roller 13 for holding the wrapping paper 9 between itself and the feed roller 13 and three wrapping rollers 24, 24, 24 are provided downstream of the feed roller 13. Moreover, there are provided a guide plate 25 immediately downstream of the feed roller 13 for preventing the wrapping paper 9 from being wound around the feed roller 13, a cutter 26 between the feed roller 13 and the wrapping rollers 24, 24, 24 for cutting off the wrapping paper 9, and a guide plate 27 disposed to face the edge of the cutter 26 for guiding the wrapping paper 9 to the wrapping rollers 24, 24, 24. In FIG. 1, the reference numeral 28 designates a supporting rod for supporting coins stacked in a coin stacking portion (not shown) between the wrapping rollers 24, 24, 24 during the coin wrapping operation.

As shown in FIG. 1, the turntable 6 consists of a disk the outer diameter of which is greater than that of the wrapping paper rolls to be used and the outer periphery thereof is formed with four cut-away portions 30, 30, 30, 30 which are circumferentially spaced at equal distances from each other. The size of each cut-away portion 30 is determined so as to permit an operator to place the wrapping paper roll 5 onto the turntable 6 by holding the wrapping paper roll 5 in his or her hands with the fingers beneath it and then passing his or her fingers downward through the cut-away portions 30 as he or she lowers the wrapping paper roll 9 onto the turntable 6.

Figure 4:
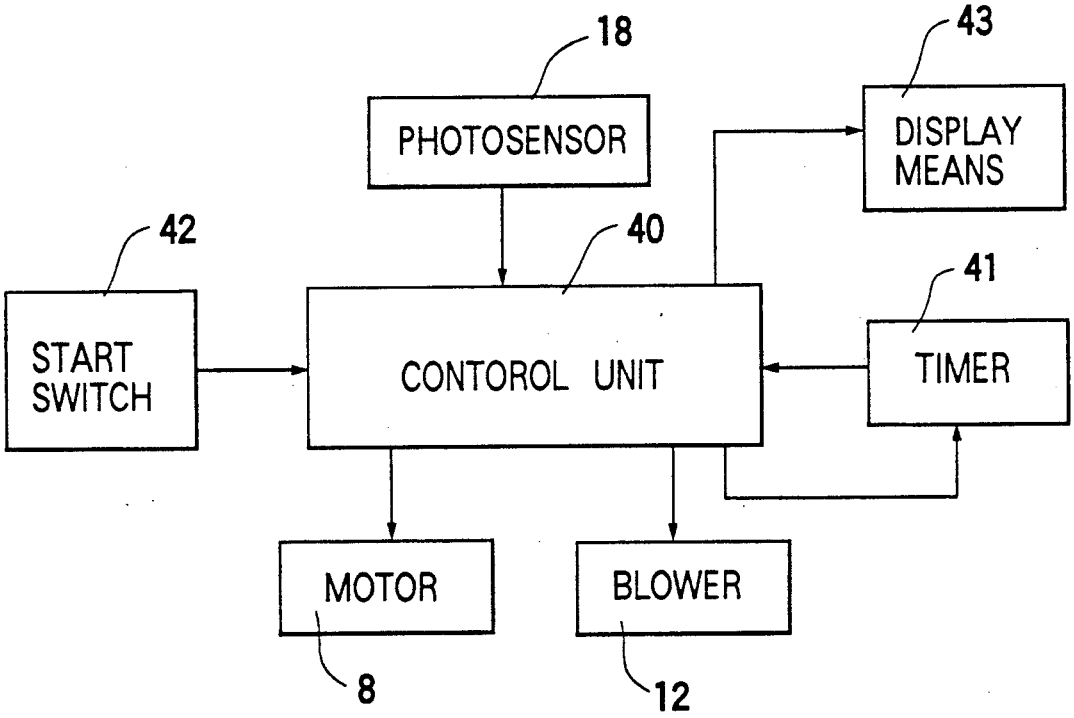
FIG. 4 is a block diagram showing a control system of a wrapping paper feeding apparatus for a coin wrapping machine which is an embodiment of the present invention.

FIG. 4 is a block diagram showing a control system of the wrapping paper feeding apparatus 1 for controlling the operation of the motor 8.

Referring to FIG. 4, the control system of the wrap ping paper feeding apparatus 1 which is an embodiment of the present invention comprises the photosensor 18 for detecting the loop of the wrapping paper 9 and outputting a loop detection signal, a control unit 40 for outputting a drive stop signal to the motor 8 when the loop detection signal is input and a drive signal to the motor 8 when the loop detection signal is not input, a timer 41 for measuring the time period during which the motor is driven based upon the drive signal output from the control unit 40 and outputting time measurement signals to the control unit 40 and, further, a start switch 42. When the start signal is input to the control unit 40 from the start switch 42, the control unit 40 causes the blower 12 to blow air from its blowing opening 11 toward the wrapping paper 9. Further, when the control unit judges that the drive period of the motor 8 exceeded a predetermined period based upon the time measurement signals input from the timer 41, it judges that the wrapping paper 9 of the wrapping roll 5 has been consumed and the remaining amount thereof has become less than a predetermined amount and outputs an alarm signal to a display means 43, thereby to cause it to display information to the effect that the wrapping paper roll 5 should be replaced.

In the thus constituted wrapping paper feeding apparatus 1 for the coin wrapping machine 2, the wrapping paper 9 is fed to the wrapping rollers 24, 24, 24 in the following manner.

At first, the wrapping paper roll 5 is placed on the turntable 6 and the wrapping paper 9 is withdrawn from the wrapping paper roll 5 until the leading end thereof reaches the position where it faces the edge of the cutter 26. At this time, the wrapping paper 9 is manually positioned along the inner face of the guide plate 14 so as to form a loop 15.

Then, the operation of the coin wrapping machine 2 and the wrapping paper feeding apparatus 1 is started by operating the start switch 42. As a result, coins are fed out one by one from a rotatable disk (not shown) into a coin passage (not shown) and counted. Further, a predetermined number of coins are stacked in the coin stacking portion (not shown) and the thus stacked coins are fed to a portion between the three wrapping rollers 24, 24, 24 where they are supported by the supporting rod 28. On the other hand, when the control unit 40 receives the start signal from the start switch 42, it drives the blower 12, thereby to cause it to blow air from its blowing opening 11 toward the wrapping paper 9. Further, the loop 15 of the wrapping paper 9 is detected by the photosensor 18 and when the loop detection signal is not input to the control unit 40, the control unit 40 outputs a drive signal to the motor 8, thereby to rotate the turntable 6 and feed out the wrapping paper 9 from the wrapping paper roll 5 for forming the loop 15. When the photosensor 18 detects the loop 15 formed in this manner, the control unit 40 outputs a drive stop signal to the motor 8, thereby to cause it to stop the rotation of the turntable 6.

As in known coin wrapping machines, the feed roller 13 is controlled so that the rotation thereof is started when the stacked coins are fed from the coin stacking portion (not shown) to the portion between the three wrapping rollers 24, 24, 24 and is stopped when a predetermined length of wrapping paper 9 has been fed to the wrapping rollers 24, 24, 24 and, therefore, when the stacked coins are fed to the portion between the wrapping rollers 24, 24, 24 and supported by the supporting rod 28, the feed roller 13 starts feeding the wrapping paper 9.

Thus, since the turntable 6 is not rotated, the wrapping paper 9 gradually moves away from the inner face of the guide plate 14 as the feed roller 13 feeds the wrapping paper 9 to the wrapping rollers 24, 24, 24. FIG. 1 shows this state.

Then, when the feed roller 13 has fed a predetermined length of the wrapping paper 9 with the turntable remaining stationary, the loop 15 becomes undetectable by the photosensor 18, whereby a loop detection signal is no longer input to the control unit 40. If the feed roller 13 should then continue to feed the wrapping paper 9 without rotating the turntable 6, a high tensile force would be produced in the wrapping paper 9 between the wrapping paper roll 5 and the feed roller 13, giving rise to a risk of slippage between the feed roller 13 and the wrapping paper 9. Therefore, in this embodiment, when the control unit 40 ceases to receive a loop detection signal from the photosensor 18, it outputs a drive signal to the motor 8, thereby to rotate the turntable 6 and cause the wrapping paper roll 5 to feed the wrapping paper 9.

Then, when the photosensor 18 again detects the loop 15 of the wrapping paper 9 and the loop detection signal is input to the control unit 40, the control unit 40 outputs a drive stop signal to the motor 8, thereby to stop the rotation of the turntable 6.

In this embodiment, since air is blown from the blowing opening 11 of the blower 12 toward the wrapping paper 9 and the guide plate 14, the wrapping paper 9 can be formed with the loop 15 in a desired manner. Therefore, when the loop 15 of the wrapping paper 9 to be detected by the photosensor 18 is formed, the photosensor 18 can detect the loop 15 without fail and when the wrapping paper 9 is not formed a loop 15 of a predetermined size, no loop 15 can be detected by the photosensor 18. As a result, since if the photosensor 18 does not detect the loop 15, the turntable 6 is rotated when the wrapping paper 9 has to be fed from the wrapping paper roll 5 and, on the other hand, the rotation of the turntable is stopped when the wrapping paper 9 should not be fed from the wrapping paper roll 5, it is possible to control the tensile force produced in the wrapping paper between the wrapping paper roll 5 and the feed roller 13 to substantially zero and, therefore, to prevent slippage between the feed roller 13 and the wrapping paper 9. The wrapping paper 9 can thus be fed to the wrapping rollers 24, 24, 24 by the feed roller 13 in the desired manner.

Thus, the feed roller 13 continues to feed the wrapping paper 9 to the wrapping rollers 24, 24, 24 and when a predetermined length of the wrapping paper 9 has been fed to the wrapping roller 24, 24, 24, the feed roller 13 is stopped, thus completing one wrapping operation.

As described above, according to the present invention, since air is blown from the blowing opening 11 of the blower 12 toward the wrapping paper 9 and the guide plate 14, it is possible to form the wrapping paper 9 with the loop 15 in a desired manner and, therefore, slippage between the feed roller 13 and the wrapping paper 9 can be prevented by detecting the loop 15 by the photosensor 18 and controlling the rotation of the turntable 6, whereby it is possible to feed the wrapping paper 9 to the wrapping rollers 24, 24, 24 by the feed roller 13 in the desired manner.

As explained in detail with reference to the preferred embodiment, according to the present invention, it is possible to provide a wrapping paper feeding apparatus for a coin wrapping machine in which a wrapping paper is withdrawn by feed roller means and stacked coins are wrapped by winding a wrapping paper therearound by use of wrapping roller means, the wrapping paper feeding apparatus being capable of preventing slippage between feed roller means and a wrapping paper and feeding the wrapping paper to wrapping roller means in a desired manner.

The present invention has thus been shown and described with reference to a specific embodiment. However, it should be noted that the present invention is in no way limited to the details of the described arrangements but changes and modifications may be made without departing from the scope of the appended claims.

For example, although the guide plate 14 is provided in the above described embodiment, since the loop 15 of the wrapping paper 9 can be formed without fail by air blown from the blower 12 and the wrapping paper 9 is fed along a predetermined path, the guide plate 14 is not necessarily required.

Further, in the above described embodiment, although the wrapping paper roll 5 is placed on the turntable 6, other means than a turntable can be used, insofar as it is rotatable and can hold the wrapping paper roll 5 thereupon.

Furthermore, in the above described embodiment, although prior to wrapping coins, the wrapping paper 9 is withdrawn from the wrapping paper roll 5 until the leading edge thereof reaches the position where it faces the edge of the cutter 26, then the start switch 42 is operated, whereby the photosensor 18 is caused to detect the loop 15 and when the loop 15 is not detected and no loop detection signal is input to the control unit 40, the control unit 40 outputs a drive signal to the motor 8, thereby to rotate the turntable 6 and feed out the wrapping paper 9 from the wrapping roll 5 until the loop 15 is detected by the photosensor 18 and then the wrapping operation is started, it is possible to manually position the wrapping paper 9 along the inner face of the guide plate 14 when the wrapping paper 9 is manually withdrawn from the wrapping roll 5 and afterwards, to start the operation of the wrapping machine 2 and the wrapping paper feeding apparatus 1, thereby to cause the feed roller 13 to start feeding the wrapping paper 9.

Moreover, in the above described embodiment, although the outer periphery of the turntable 6 is formed with four cut-away portions 30, 30, 30, 30 which are circumferentially spaced at equal distances from each other, the number of the cut-away portions 30 need be only at least two and they need not necessarily be formed so as to be circumferentially spaced at equal distances from each other.

Further, in the above described embodiment, although air is blown from the blowing opening 11 of the blower 12 toward the wrapping paper 9, nitrogen, or an inert gas such as helium can be used instead of air.

I claim:

1. A wrapping paper feeding apparatus for a coin wrapping machine in which a wrapping paper is withdrawn by feed roller means and stacked coins are wrapped by winding the wrapping paper therearound by use of wrapping roller means, said wrapping paper feeding apparatus comprising said feed roller means for withdrawing the wrapping paper from a wrapping paper roll and feeding the same to the wrapping roller means, supporting means for holding said wrapping paper roll thereon, said supporting means being rotatable in substantially the horizontal plane, drive means for rotating said supporting means, blower means disposed between said supporting means and said feed roller means for blowing gas toward the wrapping paper fed out from said wrapping paper roll so as to form the wrapping paper with a loop, sensor means for detecting said loop of the wrapping paper, and control means for causing said drive means to stop rotation of said supporting means when said sensor means detects said loop of the wrapping paper and causing said drive means to rotate said supporting means when said sensor means does not detect said loop of the wrapping paper.

2. A wrapping paper feeding apparatus for a coin wrapping machine in accordance with claim 1 wherein a guide means for guiding the wrapping paper is provided between said supporting means and said feed roller means on an opposite side to said blower means with respect to the wrapping paper.

3. A wrapping paper feeding apparatus for a coin wrapping machine in accordance with claim 1 wherein there are further provided timer means for measuring a driving time period of said drive means and outputting time measurement signals to said control means and display means for displaying information and said control means outputs an alarm signal when it judges that the driving time period of said drive means has exceeded a predetermined time period based upon the time measurement signals input from said timer means, thereby to cause said display means to display an alarm.

4. A wrapping paper feeding apparatus for a coin wrapping machine in accordance with claim 2 wherein there are further provided timer means for measuring a driving time period of said drive means and outputting time measurement signals to said control means and display means for displaying information and said control means outputs an alarm signal when it judges that the driving time period of said drive means has exceeded a predetermined time period based upon the time measurement signals input from said timer means, thereby to cause said display means to display an alarm.

5. A wrapping paper feeding apparatus for a coin wrapping machine in accordance with claim 1 wherein said supporting means consists of a turntable.

6. A wrapping paper feeding apparatus for a coin wrapping machine in accordance with claim 2 wherein said supporting means consists of a turntable.

7. A wrapping paper feeding apparatus for a coin wrapping machine in accordance with claim 3 wherein said supporting means consists of a turntable.

8. A wrapping paper feeding apparatus for a coin wrapping machine in accordance with claim 4 wherein said supporting means consists of a turntable.

9. A wrapping paper feeding apparatus for a coin wrapping machine in accordance with claim 5 wherein an outer periphery of said turntable is formed with a plurality of cut-away portions.

10. A wrapping paper feeding apparatus for a coin wrapping machine in accordance with claim 6 wherein an outer periphery of said turntable is formed with a plurality of cut-away portions.

11. A wrapping paper feeding apparatus for a coin wrapping machine in accordance with claim 7 wherein an outer periphery of said turntable is formed with a plurality of cut-away portions.

12. A wrapping paper feeding apparatus for a coin wrapping machine in accordance with claim 8 wherein an outer periphery of said turntable is formed with a plurality of cut-away portions.

13. A wrapping paper feeding apparatus for a coin wrapping machine in accordance with claim 9 wherein the outer periphery of said turntable is formed with at least two cut-away portions which are circumferentially spaced at equal distances from each other.

14. A wrapping paper feeding apparatus for a coin wrapping machine in accordance with claim 10 wherein the outer periphery of said turntable is formed with at least two cutaway portions which are circumferentially spaced at equal distances from each other.

15. A wrapping paper feeding apparatus for a coin wrapping machine in accordance with claim 11 wherein the outer periphery of said turntable is formed with at least two cutaway portions which are circumferentially spaced at equal distances from each other.

16. A wrapping paper feeding apparatus for a coin wrapping machine in accordance with claim 12 wherein the outer periphery of said turntable is formed with at least two cutaway portions which are circumferentially spaced at equal distances from each other.

* * * * *